United States Patent [19]

Thompson et al.

[11] 4,132,029

[45] Jan. 2, 1979

[54] PYRAMID FLYER

[75] Inventors: Scott Thompson; James T. Chidester, both of Denver, Colo.

[73] Assignee: Positive Pyramids, Inc., Denver, Colo.

[21] Appl. No.: 794,912

[22] Filed: May 9, 1977

[51] Int. Cl.[2] ..... A63H 27/00

[52] U.S. Cl. ..... 46/74 D; 273/106 B

[58] Field of Search ..... 46/74 D; 273/106 R, 273/106 B

[56] References Cited

U.S. PATENT DOCUMENTS

| | | | |
|---|---|---|---|
| 2,659,178 | 11/1953 | Van Hartesvelt | 46/74 D |
| 3,185,480 | 5/1965 | Weyman et al. | 46/74 D |
| 3,359,678 | 12/1967 | Headrick | 273/106 B |
| 3,566,532 | 3/1971 | Wilson | 46/74 D |
| 3,566,532 | 3/1971 | Wilson | 46/74 D |
| 3,724,122 | 4/1973 | Gillespie | 46/74 D |
| 3,828,466 | 8/1974 | Geiger | 46/74 D |
| 3,900,987 | 8/1975 | Holt | 46/74 D |
| 3,939,602 | 2/1973 | Burke | 46/74 D |

*Primary Examiner*—Louis G. Mancene
*Assistant Examiner*—Robert F. Cutting
*Attorney, Agent, or Firm*—Schuyler, Birch, Swindler, McKie & Beckett

[57] ABSTRACT

An improved aerodynamic toy for being thrown through the air in a spinning motion is disclosed. A centrally located body in the form of a many sided pyramid is attached to the circular base or saucer portion of the aerodynamic toy. The spinning motion of the aerodynamic toy enables the centrally located body to perform a number of aerodynamic functions which improve the flight performance of the aerodynamic toy. In the preferred embodiment, the centrally located body is a four sided square bottomed pyramid having an elevational profile higher than the rim and saucer portion of the aerodynamic toy.

12 Claims, 5 Drawing Figures

PYRAMID FLYER

BACKGROUND OF THE INVENTION

The present invention is directed to an aerodynamic toy adapted to be thrown through the air in a spinning motion. More specifically, the invention is directed to an aerodynamic toy which is sustained in flight by aerodynamic and gyroscopic principles brought into play by the propulsion of the aerodynamic toy along a line of flight in a spinning motion.

Over the past several years aerodynamic toys resembling flying saucers have become quite popular as throwing implements. In the usual embodiment, the toy is made of plastic material in the shape of a saucer having a depending rim located around the outer marginal edge to facilitate gripping by the user and to enhance the aerodynamic properties of the toy. The rim curves downwardly from the saucer and has a configuration such that the flying saucer, when viewed in elevation, approximates the shape of an air foil. The rim usually has a somewhat greater thickness than the saucer portion of the toy which enables the rim to create a gyroscopic action with respect to the vertical axis of the saucer portion. This gyroscopic action increases the stability of the aerodynamic toy and enhances the lift characteristics of the toy. Throwing is usually accomplished with a wrist snapping action whereby momentum and a spinning motion are imparted to the toy to cause it to fly or glide through the air. Its appeal as a toy usually resides in the fact that it exhibits definite aerodynamic characteristics and can be made to do a number of various maneuvers depending upon the skill of the user.

Various techniques have been employed in the prior art in an attempt to improve the aerodynamic properties of these aerodynamic toys. For example, efforts have been made to increase the stability of these toys by reducing the drag across the upper surface of the saucer portion. In U.S. Pat. No. 3,359,678 issued to E. E. Headrick on Dec. 26, 1967, air flow spoiling means in the form of concentic raised ribs were formed on the upper surface of the saucer portion in an attempt to create a turbulent unseparated boundary layer over the upper surface which was thought reduced drag especially in high speed flight and increased flight stability. Similarly, in U.S. Pat. No. 3,724,122 issued to R. L. Gillespie on Apr. 3, 1973, the drag across the upper surface of the saucer portion was reduced by providing a saucer portion with a substantially reduced elevational profile. This reduction in elevational profile was accomplished by incorporating a slight annular depression in the upper surface of the saucer portion. Other prior art attempts to reduce the overall aerodynamic drag during flight have focused on the desirability of reducing the thickness of the material forming the saucer portion. In U.S. Pat. No. 3,828,466 issued to Irvine D. Geiger on Aug. 13, 1974, a thin flying saucer is shown in which one or more inner boundary rings located on the upper surface of the saucer portion exert a controlled drag on this upper surface to prevent rollover. In addition, these inner boundary rings enhance the gripping ability of the thrower of the aerodynamic toy.

In addition to the above prior art attempts to influence the drag on the upper surface of the saucer portion, the prior art has also recognized that improved flight performance will be achieved by increasing the weight of the outer rim relative to the weight of the body or saucer portion of the aerodynamic toy. In U.S. Pat. No. 3,566,532 issued to H. A. Wilson on Mar. 2, 1971, the gyroscopic action of the rim portion of the flying saucer is enhanced by increasing the weight of the rim portion relative to the weight of the central body portion. This is accomplished by substantially decreasing the thickness of the body or saucer portion while at the same time the structural strength of the central body portion is maintained by attaching a hollow star shaped structure to the central body portion for structural support. This star shaped support structure is hollow in order to minimize the weight of the central body portion.

It is an object of the present invention to provide an aerodynamic toy having improved aerodynamic properties which is also easier to throw. In particular, the aerodynamic toy of the present invention combines several existing design concepts and several new and original design concepts to create a high performance flying saucer type toy thought to have unique aerodynamic properties. In this regard, it is an object of the present invention to create a secondary gyroscopic action around the vertical axis of the aerodynamic toy which supplements the gyroscopic action of the rim of the aerodynamic toy. As a result, the stability and flight performance of the aerodynamic toy of the present invention are thought to be substantially improved.

Another object of the present invention is to provide an air foil on the upper surface of the aerodynamic toy comprising a centrally located body attached to the upper surface having a higher elevational profile than the rim and upper surface. The shape of this centrally located body is thought to enhance the lift capacity of the aerodynamic toy during flight. In addition, this centrally located body is constructed of a number of intersecting flat surfaces for interrupting the air flow across this centrally located body upon throwing the aerodynamic toy in a spinning motion. The spinning action of these intersecting flat surfaces disrupts the flow of air across the flying saucer and is thought to create a turbulent unseparated boundary layer over the central portion of the flying saucer. As a result of its unique design, the aerodynamic toy of the present invention exhibits increased flight performance and improved stability.

Finally, it is an object of the present invention to increase the visable area of the toy by providing a vertically projecting central body which allows for increased visual tracking. As a result, the aerodynamic toy of the present invention can be more easily observed during flight which makes it easer to catch the aerodynamic toy of the present invention.

SUMMARY OF THE INVENTION

The present invention provides an improved version of an aerodynamic toy such as a flying saucer. The aerodynamic toy includes a circular body or disk having a fixed radius. A weighted rim is attached to the perimeter of this body or disk which generates a gyroscopic action about the vertical axis of the aerodynamic toy upon throwing the aerodynamic toy through the air in a spinning motion. In the preferred embodiment, the upper portion of the rim is attached to the perimeter of the circular base or disk. This circular base includes an annular horizontal portion having an outer perimeter attached directly to the rim of the aerodynamic toy. A depressed portion is attached to the inner perimeter of the annular horizontal portion which extends inwardly toward the center of the circular base in a slight downward slope. This depressed portion forms a gently sloping concave surface of curvature in the circular base which, when viewed in cross section, has much the same profile as a common wing. The wing effect of this depressed portion of the circular base improves the aerodynamic properties of the toy of the present invention and, in addition, provides a convenient catching and throwing grip for the human hand. The concave slope of this depressed portion is interrupted at a relatively substantial distance from the geometric center of the aerodynamic toy by the base of a pyramid structure. In the preferred embodiment, this pyramid structure is a square bottomed four sided pyramid which rises upward from its base to a point above the highest point on the circular base and the rim. Upon throwing the aerodynamic toy in a spinning motion, the weight of this pyramid structure is thought to be distributed in a ring-like fashion about the geometric center of the aerodynamic toy. Since this pyramid structure is hollow, the weight of the pyramid structure is located about the four edges of the base of the pyramid structure. Upon throwing the aerodynamic toy of the present invention in a spinning motion, the distributed weight of the pyramid structure creates a gyroscopic action about the vertical axis of the aerodynamic toy which supplements the gyroscopic action of the rim of the aerodynamic toy. This substantially enhances the stability of the aerodynamic toy about the vertical axis and results in improved flight performance. In addition, the pyramid structure adds weight to the aerodynamic toy without increasing the radius of the circular base of the toy. This also results in a more stable, longer flying toy without the necessity of making the toy larger and bulkier.

One of the principle features of the present invention is the location of the pyramid structure of the present invention with respect to the rim of the aerodynamic toy. The depressed portion of the circular base is designed in such a fashion that the center of gravity of the pyramid structure is substantially co-planar with the center of gravity of the rim. As a result, the gyroscopic action of the pyramid structure supplements the gyroscopic action of the rim during the spinning motion of the aerodynamic toy. Because this additional gyroscopic action is thought to aid the gyroscopic action of the rim, the gyroscopic stability of the toy is substantially improved which results in improved flight performance. Also, because the base of the pyramid structure is lower than the top of the rim, the wing-like depressed portion in combination with the centrally located pyramid structure results in an aerodynamic property generally known as the Coanda effect. Because of this Coanda effect, flight performance is further improved.

The pyramid structure of the present invention is in itself an aerodynamic body. First of all, the edges of the pyramid structure, particularly the bottom edges, provide structural integrity to the pyramid flyer. Also, the edges of the pyramid structure provide four air spoiling disrupters for the air flowing around the pyramid during flight. The edges of the pyramid fan the air and are thought to create drag forces as well as a turbulent unseparated boundary layer over the top and around the sides of the pyramid structure which enhance the flight performance and stability of the aerodynamic toy. In addition, in the preferred embodiment, the pyramid structure of the present invention has an elevation higher than the elevation of the circular base and the rim. As a result, the pyramid structure functions as an air foil which improves the flight performance of the aerodynamic toy. Also, because of the height of the pyramid structure, the pyramid structure acts as a rubber to stabilize the lateral direction of the pyramid flyer and it acts as a roll stabilizer.

Although in the preferred embodiment, the aerodynamic toy of the present invention incorporates a four sided pyramid structure centrally located on the circular base, other geometric forms may be located on the circular base to create the above-described aerodynamic properties. For example, any geometric body having a ring-like distribution of weight upon being subject to a spinning motion may be attached to the circular base of the aerodynamic toy to create the above mentioned secondary gyroscopic action which is thought to enhance the stability and flight performance of the aerodynamic toy. These other geometric bodies may also have an elevational profile higher than the elevational profile of the circular base and rim for the reasons described above. Also, these other geometric bodies should have flat intersecting surfaces such as the intersecting surfaces of the four sided pyramid. Thus, the present invention is not limited to the use of a four sided pyramid structure as shown in the preferred embodiment. However, the four sided pyramid structure is the most suitable geometric form for use in an aerodynamic toy according to the present invention because it uniquely combines all the aerodynamic properties described above in a single structure.

DETAILED DESCRIPTION OF THE INVENTION

Figure 1:
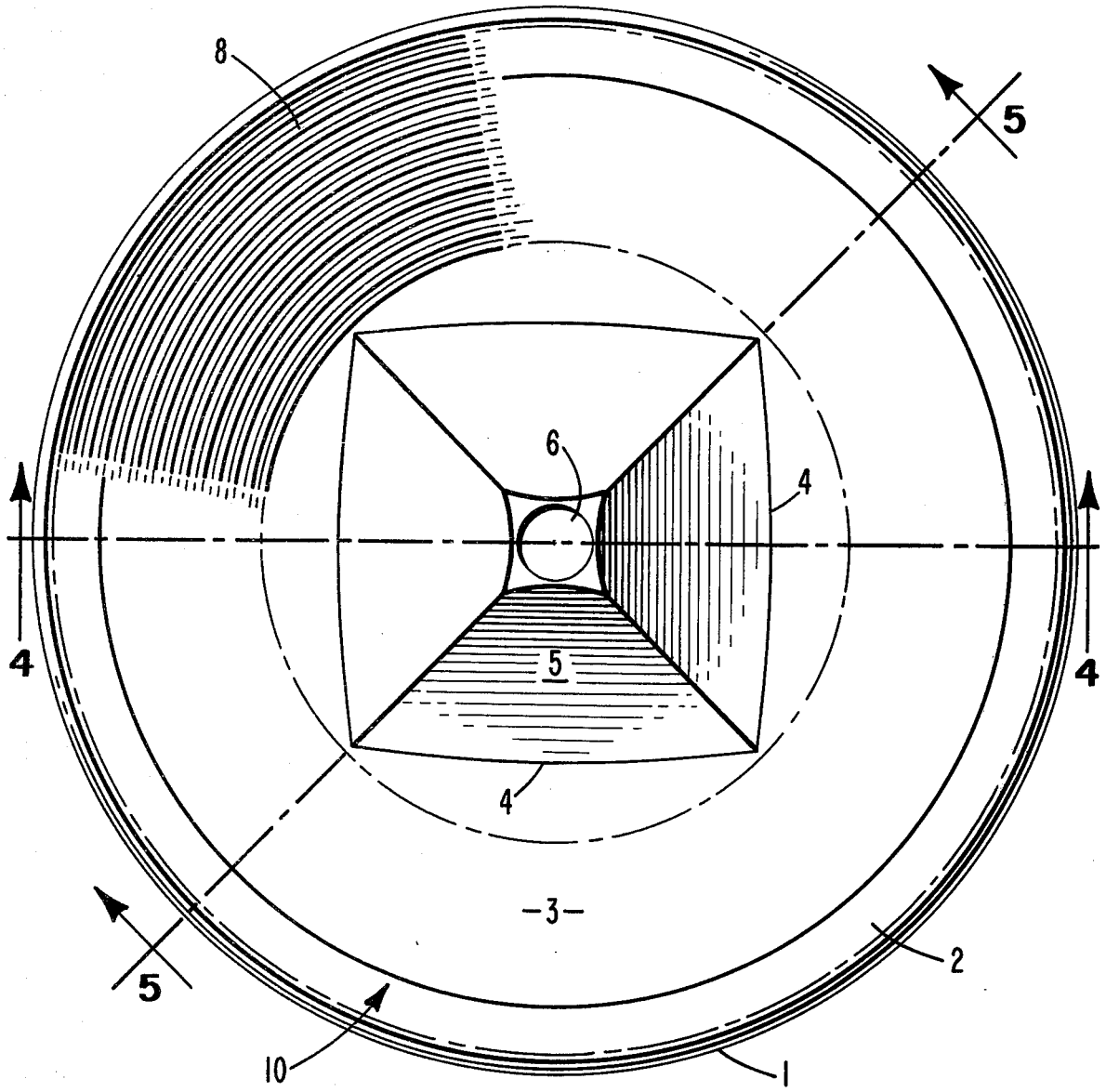
FIG. 1 is a top view of the aerodynamic toy of the present invention.

As shown in FIG. 1 the aerodynamic toy of the preferred embodiment includes a circular base 10 which has a rim 1 attached to its perimeter. The circular base includes an annular horizontal portion 2 and a depressed portion 3. The shape of the horizontal portion 2 and the depressed portion 3 are best illustrated in the cross sectional views of FIGS. 4 and 5 described below. A centrally located body 5 in the form of a four sided pyramid is attached to the circular base 10. As shown in FIG. 1, the connecting points 4 are slightly curved due to the downward slope of the depressed portion 3 of the circular base 10. The depressed portion 3 slopes gradually downward from the horizontal portion 2 to the connecting points 4 with the pyramid 5 as illustrated in the cross sectional views in FIGS. 4 and 5. Thus, the corners of the square bottomed base of the pyramid 5 are at a higher elevation than the mid points of the apothematic sides of the base of the pyramid structure 5. This explains the slight curvature of the connecting points 4 of the pyramid structure 5. The pyramid structure 5 also may include an aperture or hole 6 at its apex. Finally, as shown in FIG. 1 a plurality of concentric discontinuities or ribs are present on the horizontal portion 2 and a part of the depressed portion 3 of the circular base 10 of the aerodynamic toy of the present invention.

Figure 2:
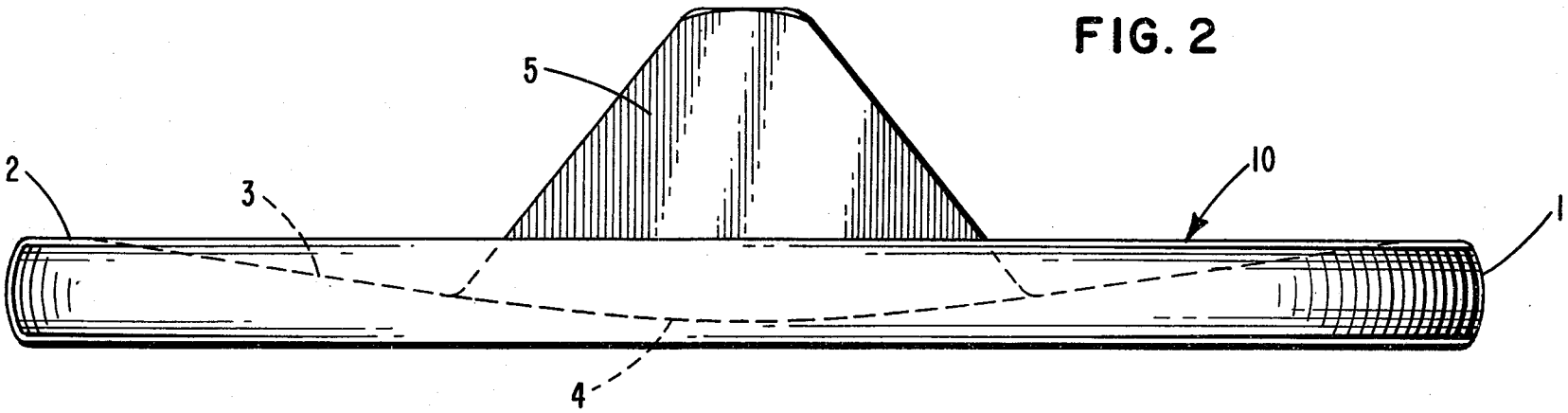
FIG. 2 is an apothematic side view of the aerodynamic toy of FIG. 1.
Figure 3:
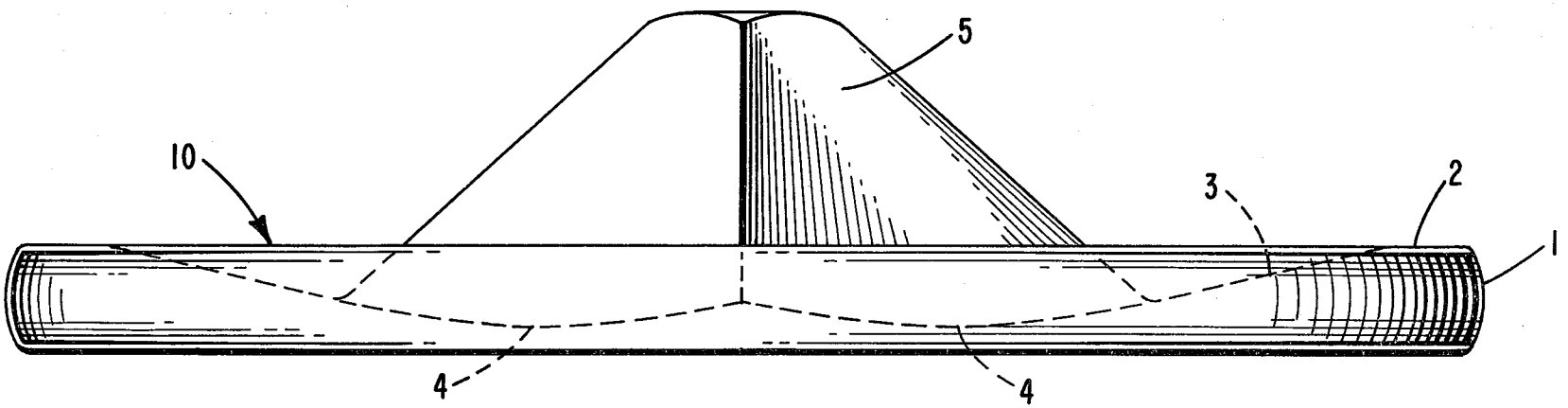
FIG. 3 is a diagonal side view of the aerodynamic toy of FIG. 1.

The apothematic side view and the diagonal side view of the aerodynamic toy of the present invention are shown in FIGS. 2 and 3, respectively. The apothematic side view shows the shape of the pyramid structure 5 from a direction facing one of the flat surfaces of the pyramid structue 5. The diagonal side view shows the shape of the pyramid structure from a direction facing the intersection of two of the flat surfaces of the pyramid structure 5. A comparison of these two figures illustrates the change in slope of the pyramid structure 5 as the aerodynamic toy is rotated, as for example, when thrown through the air in a spinning motion. This change in slope is characteristic of a four sided pyramid and in itself is thought to enhance the aeodynamic properties of the aerodynamic toy of the present invention. The four edges of the pyramid structure 5 function as disrupters for the air flowing about the pyramid structure 5 during the flight of the aerodynamic toy. These edges fan the air and are thought to create drag forces and a turbulent unseparated boundary layer over the top and around the sides of the aerodynamic toy which enhance flight distance and stability.

As shown in FIGS. 2 and 3, the pyramid structue 5 has a hole 6 at its apex and is connected to the circular base 10 of the aerodynamic toy at connecting points 4. The circular base 10 includes an annular horizontal portion 2 and a depressed portion 3 which connects the inner perimeter of the horizontal portion 2 to the pyramid structure 5. The connecting points 4 between the pyramid structure 5 and the depressed portion 3 have a slight curvature due to the downward slope of depressed portion 3. Thus, as shown in FIGS. 2 and 3, the elevation of the connecting points 4 at the intersecting edges of the flat surfaces of the pyramid structure 5 is higher than the intersection of the mid point of the flat surfaces of the pyramid structure 5 and the connecting points 4. The horizontal portion 2 of the circular base 10 has an outer perimeter which is connected to the rim 1 of the aerodynamic toy. As shown in FIGS. 2 and 3, the rim 1 has a slight concave surface of curvature with respect to the inside of the aerodynamic toy of the present invention.

Figure 4:
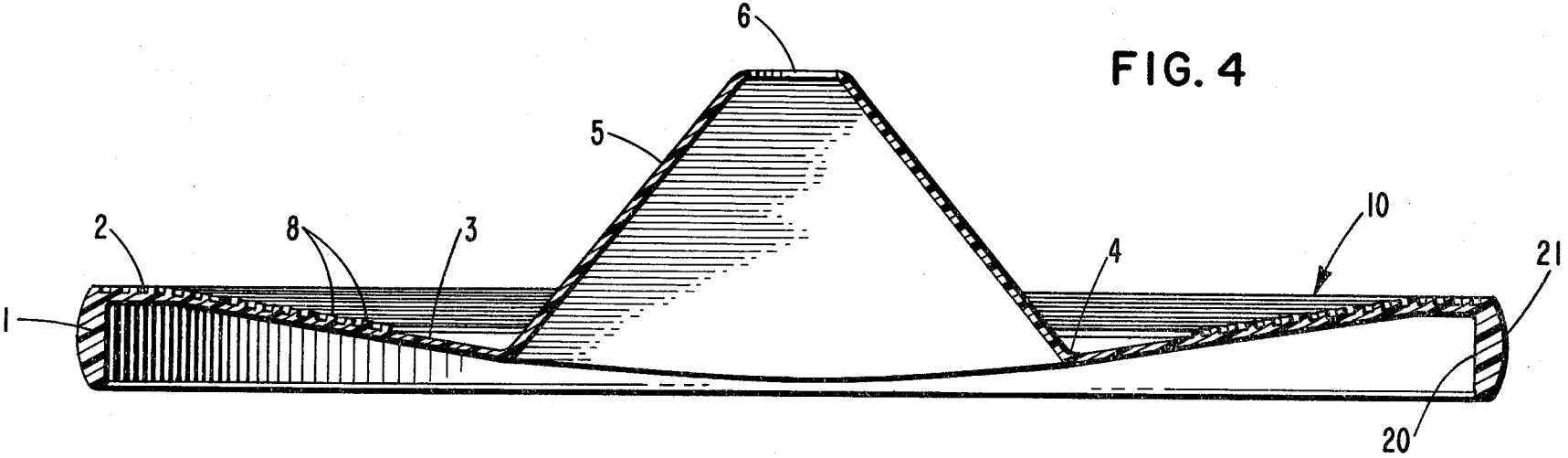
FIG. 4 is an apothematic cross section taken along the lines 4—4 of FIG. 1.
Figure 5:
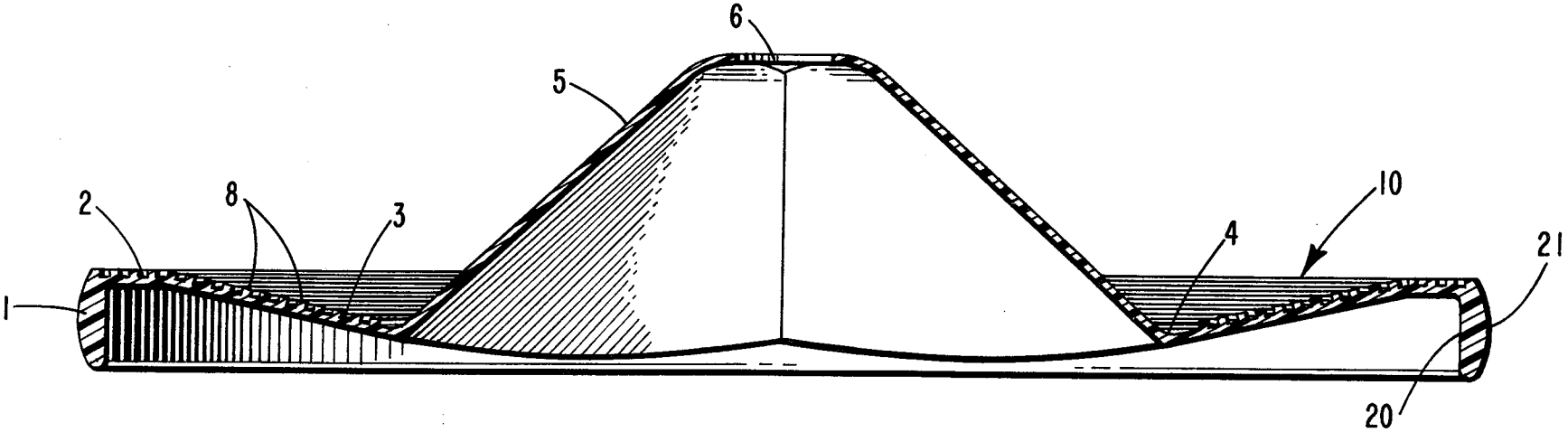
FIG. 5 is a diagonal side view taken along the lines 5—5 of FIG. 1.

The apothematic cross section of the aerodynamic toy of the present invention taken along lines 4—4 of FIG. 1 is shown in FIG. 4 and the diagonal cross section taken along lines 5—5 of FIG. 1 is shown in FIG. 5. The rim 1 has an outer surface 21 which is concave with respect to the inside of the aerodynamic toy and an inside surface 20 which is generally flat. Because the rim 1 shown in FIGS. 4 and 5 is significantly thicker than the other portions of the aerodynamic toy, the rim 1 is weighted with respect to these other portions. This weight is distributed evenly about the geometric center of the aerodynamic toy so that the spinning action of the rim 1 upon throwing the aerodynamic toy through the air creates a gyroscopic action with respect to the vertical axis of the aerodynamic toy. This gyroscopic action enhances the stability of the aerodynamic toy with respect to the vertical axis and improves the other aerodynamic properties of the toy such as lift during flight. The rim 1 is connected to the horizontal portion 2 of the circular base 10. This horizontal portion 2 extends inward from the rim 1 a short distance to the connection with the depressed portion 3 of the circular base 10. The depressed portion 3 has a slight downward slope from the horizontal portion 2 to the connecting points 4 of the pyramid structure 5. The combination of the rim 1, the horizontal portion 2 and the depressed portion 3 forms an air foil similar to a common wing. As shown in FIGS. 4 and 5, the horizontal portion 2 and a part of the depressed portion 3 contain a plurality of concentric raised ribs or discontinuities 8. These discontinuities 8, by interrupting the flow of air across the upper surface of the toy, are thought to create a turbulent unseparated buondary layer of air which enhances the flight stability and aerodynamic performance of the flyer. In addition, the rim 1, the horizontal portion 2 and the depressed portion 3 create an excellent gripping surface for the user of the aerodynamic toy. The circular discontinuities 8 also enhance the gripping of the aerodynamic toy. The connecting points 4 between the depressed portion 3 and the pyramid structure 5 are reinforced due to the added stress which occurs between the depressed portion 3 and the pyramid structure 5. In addition, the weight of this reinforced area 4 supplements the weight of the pyramid structure 5 and enhances the gyroscopic action of the pyramid structure 5 as described below. Since the pyramid structure 5 is a hollow structure, the weight of the pyramid structure 5 is predominantly distributed about the third lowest part of the pyramid structure. Thus, the bulk of the mass of the pyramid structure is located geneally in the area surrounding the lowest third of the pyramid structure. When the pyramid structure 5 is made to rotate on its vertical axis, this distribution of weight creates a gyroscopic action around the base of the pyramid structure which enhances the stability of the aerodynamic toy by supplementing the gyroscopic action of the rotating rim 1. In addition, as shown in FIG. 4, the downward slope of the depressed portion 3 aligns the center of gravity of the pyramid structure 5 with the center of gravity of the rim 1. Thus, the center of gravity of rim 1 is essentially co-planar with the center of gravity of the pyramid structure 5. In this position, the gyroscopic action of the pyramid structure 5 is thought to fully aid or supplement the gyroscopic action of the rim 1.

As shown in FIGS. 4 and 5, the pyramid structure 5 has a higher elevational profile than the circular base 10 and the rim 1. This high elevational profile enables the pyramid structure 5 to function as an air foil which enhances the aerodynamic properties of the aerodynamic toy of the present invention. As shown therein, the profile of the pyramid structure 5 of the present invention changes as the pyramid structure 5 rotates about the geometric center of the aerodynamic toy. As described above, this change in the profile of the pyramid structure 5 is thought to give the pyramid structure unique aerodynamic properties which enhance the performance of the toy of the present invention. The pyramid structue 5 also may includes an aperture or hole 6 at the apex of the pyramid structure 5 which permits air to escape from the under side of the aerodynamic toy during flight. As illustrated in FIGS. 4 and 5, the pyramid structure 5 is shaped in a manner similar to the shape of a common parachute. Thus, the hole 6 at the apex of the pyramid structure 5 functions in a manner very similar to that achieved by the opening in the crown of a common parachute.

Although the present invention is not hereby restricted, a convenient size for the aerodynamic toy of the present invention is approximately 10¼ inches in total diameter and a total elevational profile from the bottom of the rim 1 to the top of the pyramid structure 5 of about 2 5/16 inches. The rim 1, which is preferably three-fourth inches in height, has a central thickness of approximately 3/16 inches and an outer thickness of approximately 1/16 inches. The horizontal portion 2 is approximately one-half inches in length, that is, the difference between the inner and outer radii is approximately one-half inch. The thickness of the circular base 10 and the pyramid structure 5 is approximately 1/32 inches. The slope of the depressed portion 3 is approximately 14 degrees with respect to the horizontal plane. As a result of this downward slope, the depressed portion 3 intersects the pyramid structure 5 at approximately 2 13/16 inches from the geometric center of the aerodynamic toy with respect to the diagonal of the pyramid structure 5. The depressed portion 3 intersects the pyramid structure 5 at approximately 2 ⅛ inches from the geometric center with respect to the mid point of the flat surfaces of the pyramid structure 5 as shown in the apothematic cross section of FIG. 4. As a result, the elevational profile of the connecting points 4 between the depressed portion 3 and the pyramid structure 5 varies with respect to the horizontal plane across the bottom of the aerodynamic toy from 3/16 inches to ⅛ inches. The concentric raised ribs or discontinuities extend across the horizontal portion 2 and 1½ inches inward toward the geometric center of the aerodynamic toy along the depressed portion 3. The pyramid structure 5 has a diagonal base of approximately 6 inches with respect to the horizontal plane across the bottom of the aerodynamic toy although, with respect to the connecting points 4, the diagonal base of the pyramid structure 5 is approximately 5 and 10/16 inches. The slope of the edges of the pyramid structure 5 as shown in the diagonal cross section of FIG. 5 is approximately 42 degrees and the slope of the surfaces of the pyramid structure 5 as shown in the apothematic cross section of FIG. 4 is approximately 52 degrees. The horizontal portion at the apex of the pyramid structure 5 is approximately three-fourth inches in width. While the above dimensions are not extremely or precisely critical, they represent an operative embodiment of the invention. An aerodynamic toy of the above dimensions operates in accordance with the specified objectives of the present invention. This preferred embodiment of an aerodynamic toy significantly improves the aerodynamic properties of such toys.

Although illustrative embodiments of the invention have been described in detail with reference to the accompanying drawings, it is to be understood that the invention is not limited to those precise embodiments and that various changes or modifications may be affected therein by one skilled in the art without departing from the scope or spirit of the invention. Although in the preferred embodiment, a four sided pyramid structure is attached to the circular base 10 of the aerodynamic toy of the present invention, other geometric structures may also be attached to the circular base which perform one or more of the functions of the pyramid structure of the present invention. For example, a different geometric structure may be attached to the circular base which performs the function of creating a secondary gyroscopic action about the vertical axis of the aerodynamic toy which supplements the gyroscopic action of the rim. The center of gravity of this geometric structure may likewise be aligned in a co-planar fashion with the center of gravity of the rim 1 in the manner described above with respect to the pyramid structure. The four sided pyramid structure is used in the preferred embodiment of the present invention because it uniquely combines a number of aerodynamic properties in a single structure which substantially improves the performance of aerodynamic toys.

We claim:

1. An aerodynamic toy for being thrown through the air in a spinning motion comprising a substantially planar circular base having a vertical axis perpendicular to said circular base and extending through the geometric center of said circular base, a rim attached to the perimeter of said circular base for stabilizing the movement of said circular base about said vertical axis due to the spinning motion of said rim, a centrally located pyramid structure attached to said circular base for enhancing the aerodynamic properties of said aerodynamic toy.

2. An aerodynamic toy as defined in claim 1 wherein said circular base comprises a depressed portion extending from near the top of said rim toward the outer perimeter of said centrally located pyramid structure, said depressed portion having a gradual downward slope from near the top of said rim to said centrally located pyramid structure.

3. An aerodynamic toy as defined in claim 1 wherein said said depressed portion contains a plurality of concentric circular discontinuities.

4. An aerodynamic toy as defined in claim 2 wherein said centrally located pyramid structure has a higher elevational profile than said circular base and said rim.

5. A aerodynamic toy as defined in claim 4 wherein said centrally located pyramid structure has a plurality of intersecting flat surfaces for interrupting the air flow across said centrally located pyramid structure upon throwing said aerodynamic toy in a spinning motion.

6. An aerodynamic toy as defined in claim 5 wherein said centrally located pyramid structure is hollow.

7. An aerodynamic toy as defined in claim 5 wherein said centrally located pyramid structure is a four sided pyramid.

8. An aerodynamic toy for being thrown through the air in a spinning motion comprising a substantially planar circular base, a rim attached to the perimeter of said circular base for stabilizing the movement of said aerodynamic toy due to the spinning motion of said rim, a four sided pyramid centrally located on said circular base for enhancing the aerodynamic properties of said aerodynamic toy.

9. An aerodynamic toy as defined in claim 8 wherein said four sided pyramid has a higher elevation profile than said circular base and said rim.

10. An aerodynamic toy as defined in claim 9 wherein said four sided pyramid is hollow.

11. An aerodynamic toy as defined in claim 8 wherein said circular base comprises a depressed portion extending from near the top of said rim toward the outer perimeter of said four sided pyramid, said depressed portion having a gradual downward slope from near the top of said rim to said four sided pyramid.

12. An aerodynamic toy as defined in claim 11 wherein said depressed portion contains a plurality of concentric circular discontinuities.

* * * * *